US007388511B2

(12) United States Patent
Amand

(10) Patent No.: US 7,388,511 B2
(45) Date of Patent: Jun. 17, 2008

(54) SYSTEM FOR REMOTE CONTROL OF IDENTICAL DEVICES

(75) Inventor: Frank Amand, Louvain (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 233 days.

(21) Appl. No.: 10/496,549

(22) PCT Filed: Oct. 31, 2002

(86) PCT No.: PCT/IB02/04604

§ 371 (c)(1),
(2), (4) Date: May 25, 2004

(87) PCT Pub. No.: WO03/046858

PCT Pub. Date: Jun. 5, 2003

(65) Prior Publication Data

US 2005/0009173 A1 Jan. 13, 2005

(30) Foreign Application Priority Data

Nov. 29, 2001 (EP) ..... 01204612

(51) Int. Cl.
*G08C 19/00* (2006.01)

(52) U.S. Cl. ..... 340/825.69; 340/825.72

(58) Field of Classification Search ..... 340/825.69, 340/825.72; 455/345, 352, 151.4; 341/176; 359/146, 148

See application file for complete search history.

(56) References Cited

U.S. PATENT DOCUMENTS 4,884,055 A * 11/1989 Memmola ..... 340/426.28
5,402,257 A * 3/1995 Hasselmann et al. ..... 398/109
5,854,594 A * 12/1998 Lin et al. ..... 340/825.72
5,940,007 A * 8/1999 Brinkmeyer et al. ... 340/825.69
5,949,351 A * 9/1999 Hahm ..... 340/825.72
5,959,539 A * 9/1999 Adolph et al. ..... 340/3.5
6,005,508 A * 12/1999 Tsui ..... 341/173
6,160,491 A * 12/2000 Kitao et al. ..... 340/825.69

* cited by examiner

*Primary Examiner*—Brian Zimmerman
*Assistant Examiner*—Nam Nguyen

(57) ABSTRACT

The invention relates to a system for remote control of at least two controllable devices, the system comprising a remote control device (6) with communicating means for communicating to the controllable devices a user-specified command produced by the remote control device. The invention also relates to a method of remote control of at least two controllable devices, the method comprising the step of communicating a user-specified command to the controllable devices (4, 5). The method comprises the further steps of adding the user-specified command a device identifier for identification of at least one of the controllable devices; transmitting the device identifier and the user-specified command, receiving the device identifier and the user-specified command; extracting the device identifier, comparing said extracted device identifier with a further device identifier for identification of the controllable device, refraining from further operation with the received user-specified command if said identifiers do not match, and supplying the user-specified command to the controllable device.

6 Claims, 3 Drawing Sheets

SYSTEM FOR REMOTE CONTROL OF IDENTICAL DEVICES

The invention relates to a system for remote control of at least two controllable devices, the system comprising a remote control device with communicating means for communicating to the controllable devices a user-specified command produced by the remote control device.

The invention also relates to a method of remote control of at least two controllable devices, the method comprising the step of communicating a user-specified command to the controllable devices.

An embodiment of such a system is known from U.S. Pat. No. 5,748,263.

Well known remote control systems include consumer electronics products, such as a television set (TV), videocassette recorder (VCR), which are remote-controllable devices and can receive user commands produced by means of a remote control device. Sometimes, such remote control systems involve two or more controllable devices, which may be identical. When the controllable devices are situated fairly close to each other, a signal of the remote control device may reach not only the targed-controllable device, but also another controllable device. Both devices will receive the signal and respond to it. This situation may occur in the showrooms of shops, exhibition pavilions, studios with professional electronics equipment, home theaters and other places with controllable devices, like TVs, VCRs, digital versatile disk (DVD) recorders, etc.

It is known to communicate to a group of apparatuses by assigning unique addresses to the apparatuses and indicating these addresses at the apparatuses themselves. Consequently, these apparatuses are unique and not identical. It is also already known from U.S. Pat. No. 5,774,673 to communicate between apparatuses with the help of using applications stored in these apparatuses. Thus, current remote control systems with a one-directional communication do not allow control of the identical remote-controllable devices without using special software, introducing any differences or hardware changes into the identical apparatuses or storing the unique pre-assigned addresses in said identical devices.

For many consumer electronics products, an infrared light is commonly used as a carrier for wireless communication. Thus, it is also necessary to develop a remote control system that can be adapted to operate with the infrared devices.

It is an object of the invention to provide a system for remote control of at east two controllable devices of the kind defined in the opening paragraph, which will be able to identify identical controllable devices and control them independently of each other.

The object of the invention is realized in that:

- the remote control device is equipped with a coding device comprising an input means for obtaining the user-specified command from the remote control device; a coding means designed to add to the user-specified command a device identifier for identification of at least one of the controllable devices; a transmitting means adapted to transmit the device identifier and the user-specified command;
- the controllable device is equipped with a decoding device comprising a receiving means adapted to receive the device identifier and the user-specified command; a decoding means designed to extract the device identifier; to compare said extracted device identifier with a further device identifier for identification of the controllable device; to refrain from further operation with the received user-specified command if said identifiers do not match; an output means for supplying the user-specified command to the controllable device.

In this way, the system of the invention comprises the coding device and the decoding device and allows control of identical devices. It is assumed that the controllable devices could be conventional controllable devices and are not necessarily identical.

There are many possibilities for implementation of the system of the present invention. The coding and decoding devices could be designed as devices which are not dependent on the implementation of the remote control device and controllable devices. Thus, the coding device includes receiving means for obtaining the command from the remote control device and could be manufactured as a separate device. Similarly, the decoding device includes transmitting means and may be separate from the controllable device. It is also supposed that the receiving and transmitting means of the coding and decoding devices are suitable to communicate with the receiving and transmitting means of the remote control device and controllable devices.

Another possibility for implementation of the system of the present invention may be to design the coding device and the decoding devices in combination with the remote control device and the controllable devices, respectively. For example, the communicating means of the remote control device may be combined with the transmitting means of the coding device, and the communicating means of the controllable device may be combined with the receiving means of the decoding device.

The object of the invention is also realized in that the method of the invention comprises the further steps of:

- adding to the user-specified command a device identifier for identification of at least one of the controllable devices;
- transmitting the device identifier and the user-specified command;
- receiving the device identifier and the user-specified command;
- extracting the device identifier; comparing said extracted device identifier with a further device identifier for identification of the controllable device; refraining from further operation with the received user-specified command if said identifiers do not match;
- supplying the user-specified command to the controllable device.

The method of the invention describes steps of operation of the system for remote control of at least two controllable devices.

These and other aspects of the invention will be further elucidated with reference to the accompanying drawings, wherein.

Figure 1:
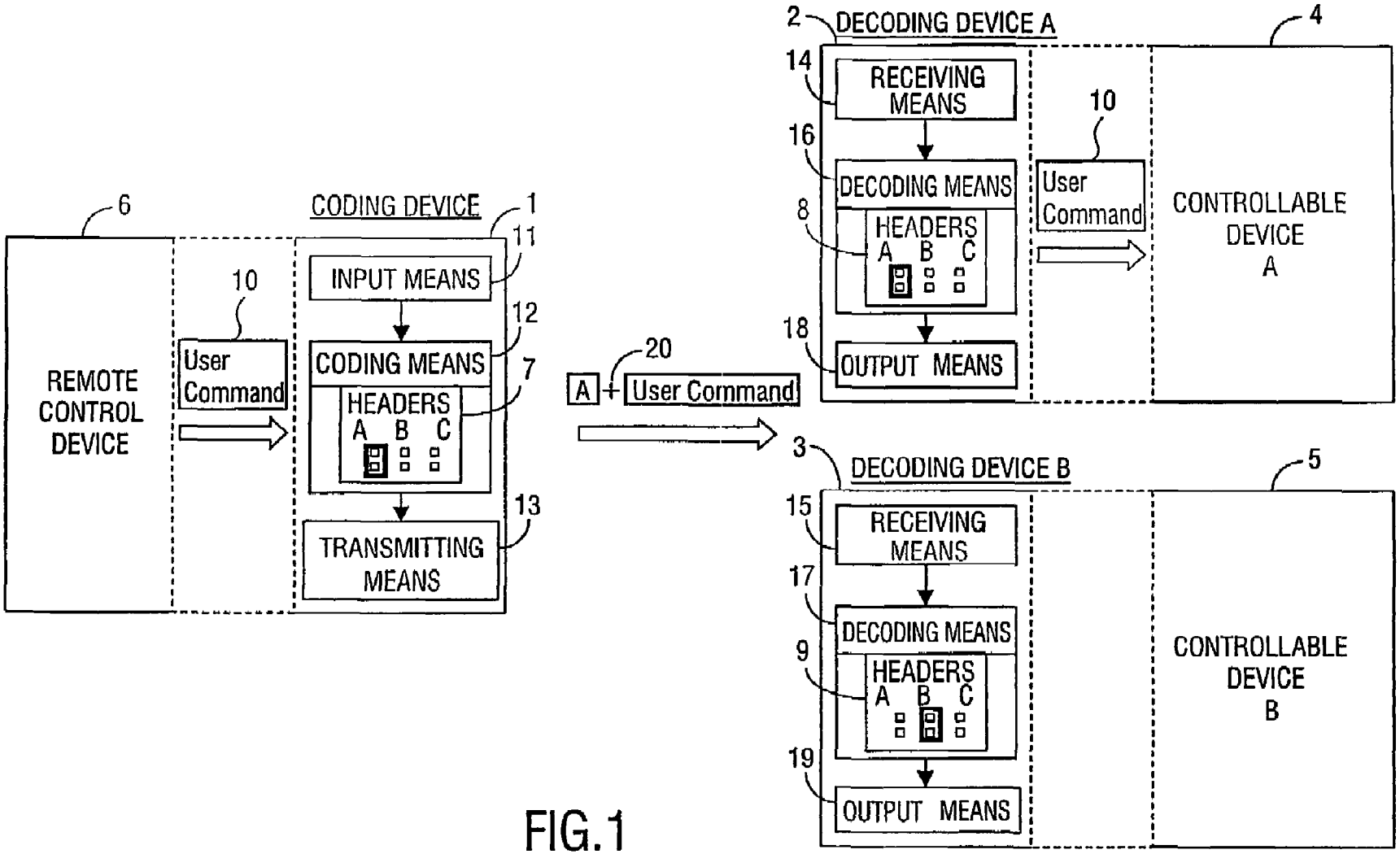
FIG. 1 shows an embodiment of the system and method of the present invention, block diagrams of the coding and decoding devices and a general principle of operation of said system.

Referring now to the drawings, FIG. 1 shows an embodiment of the system and method of the present invention. The Figure shows the block diagram of the coding device 1 and the block diagram of the decoding devices 2 and 3 associated with the controllable devices 4 and 5, respectively. The method of the invention and the general operation principle of the system are also disclosed with reference to the FIG. 1.

The remote control device 6 may have a number of keys, which generally include numerical keys, function keys and means 7 for selecting a device identifier associated with the controlled device, like the controllable device 4 or 5. An extra switch on the remote control device or coding device could implement said means for selection of the device identifiers. The decoding devices 2,3 may include means 8,9 for setting further device identifiers associated with the controlled devices 4, 5.

In FIG. 1, a selection between the device identifiers A, B and C is used as an example with the aim to explain the present invention. The device identifiers could be selected independently in the coding and decoding devices. Thus, it is shown in FIG. 1 that the further device identifier A is selected in the coding device 1 and the further device identifier B is set in the decoding device 3.

The remote control device 6 produces the user-specified command 10. The coding device 1 comprises input means 11, coding means 12 and transmitting means 13. Thus, the coding device 1 may obtain the user-specified command 10 using the input means 11. Then, the coding means add to the user-specified command the selected device identifier, which can be assigned to the specific controllable device or a group of the controllable devices. The transmitting means 13 of the coding device 1 further transmit a signal 20 incorporating the user-specified command and the device identifier to be received by the decoding devices.

The decoding devices 2, 3 comprise receiving means 14, 15, decoding means 16, 17 and output means 18, 19. The user-specified command and the device identifier 20 are being received by the receiving means 14, 15 of the decoding devices 2, 3. Then the decoding means 16, 17 extract the received device identifier and compare it with the further device identifier, which identifies the associated controllable device. The decoding means refrain from further operation with the received user-specified command if said identifiers do not match. If the received device identifier and the further device identifier, which identifies the associated controllable device, do match, the output means of the decoding device further supply the received user-specified command to the associated controllable device.

As is shown in FIG. 1, the further device identifier A is set in the decoding device 2 and the further device identifier B is set in the decoding device 3. The coding device 1 transmits the user-specified command with the device identifier A. In this connection, only the controllable device 4 will receive the user-specified command 10 produced by the remote control device 6, because the further device identifier A is set in decoding device 2 but not in the decoding device 3.

Figure 2:
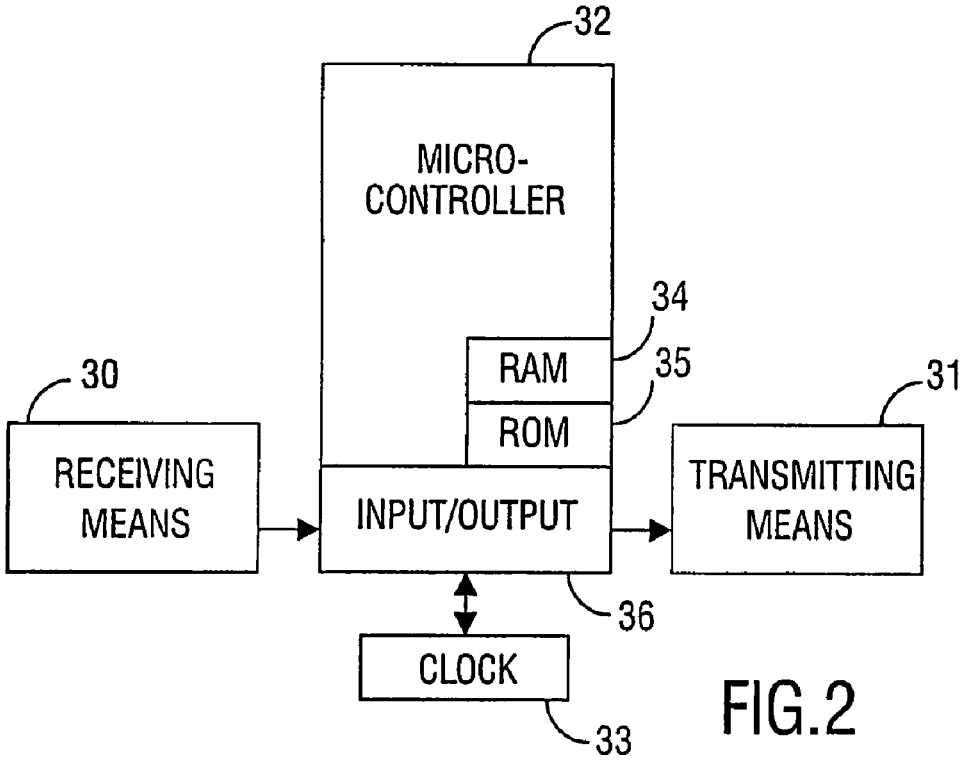
FIG. 2 shows an embodiment of the system of the present invention, in which a schematic diagram of the processor that could be embedded in the coding or decoding device is shown.

FIG. 2 shows an embodiment of the system of the present invention with a schematic diagram of the processor that could be embedded in the coding or decoding device.

The coding and decoding devices can be implemented separately from the remote control device and controllable devices. In this case, the coding device may include receiving means for obtaining the user-specified command from the remote control device, and the decoding device may include transmitting means for supplying the user-specified command to the controllable device. However, there is a requirement that said receiving means of the coding device can communicate with the transmitting means of the remote control device and said transmitting means of the decoding device can communicate with the receiving means of the controllable device.

In this way, the coding or decoding devices can be realized as is shown in FIG. 2. The embodiment comprises receiving means 30, transmitting means 31, a microcontroller 32 and a clock 33. The microcontroller 32 has an embedded random access memory 34 and an embedded read-only memory 35, which is used for program storage. The microcontroller 32 could implement the coding means of the coding device or the decoding means of the decoding device. Depending on the first or second implementation, the coding means of the coding device or the decoding means of the decoding device can be realized. When the coding means is realized, an input/output function 36, the receiving means 30 and the transmitting means 31 are adapted to receive the user-specified command from the remote control device and to transmit the user-specified command and selected device identifier. When the decoding means is realized, the input/output function 36, the receiving means 30 and the transmitting means 31 are adapted to receive the user-specified command and the device identifier from the coding device and to transmit the user-specified command to the controllable device. Additionally, the microcontroller 32 can be equipped with the display, the keypad and other communication means. The blocks in FIG. 2 are well known in the prior art and are not further discussed herein.

Figure 3:
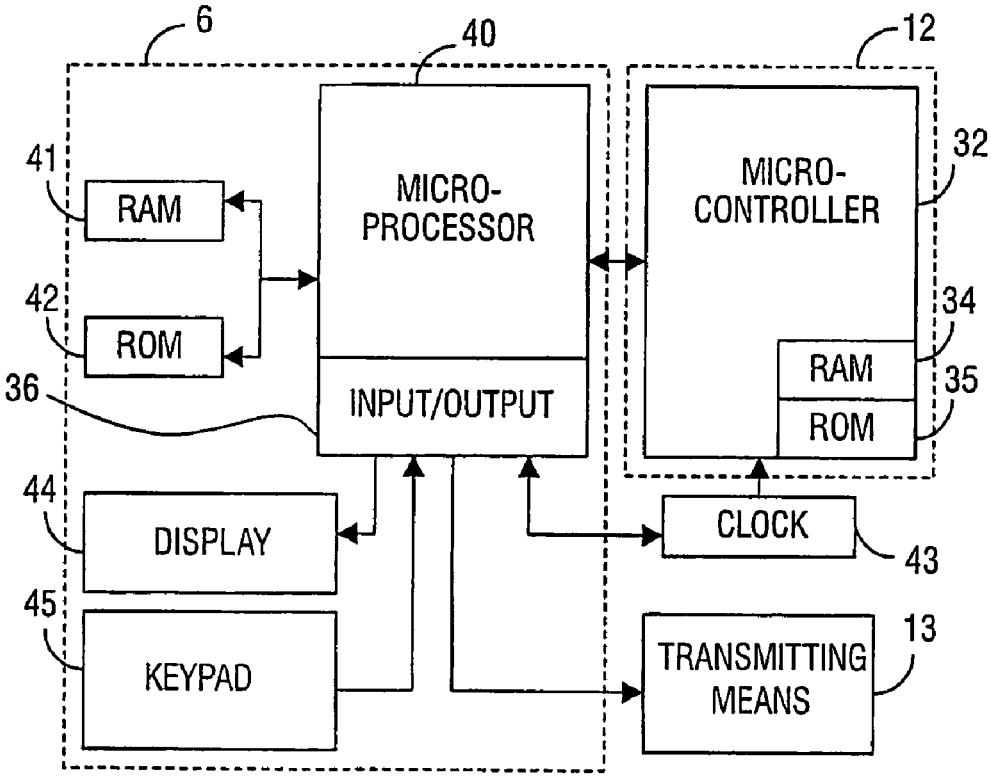
FIG. 3 shows an embodiment of the system of the present invention, in which a schematic diagram of the remote control device and coding device with combined transmitting means is shown.
Figure 4:
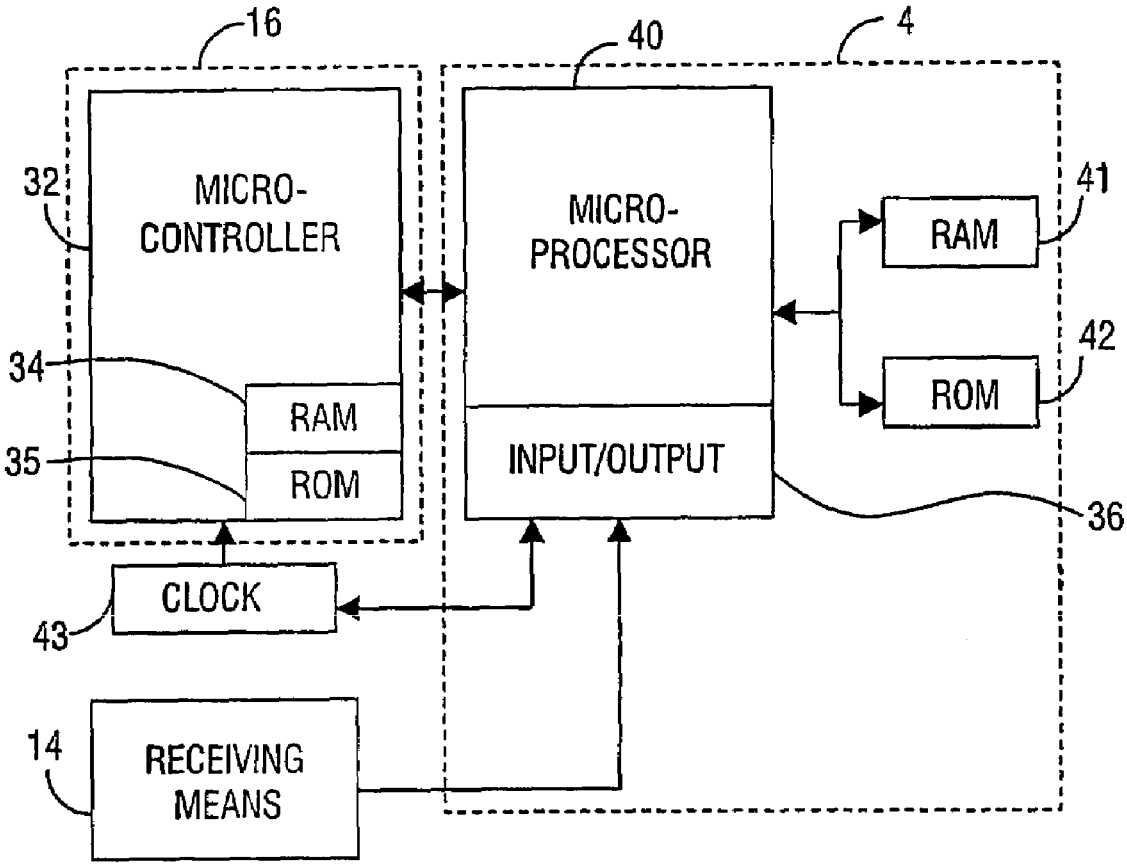
FIG. 4 shows an embodiment of the system of the present invention, in which a schematic diagram of the controllable device and decoding device with combined receiving means is shown.

FIG. 3 shows an embodiment of the system of the present invention, in which a schematic diagram of the remote control device and coding device with a combined transmitting means is shown. FIG. 4 shows a schematic diagram of the controllable device and decoding device with a combined receiving means.

FIG. 3 shows the coding device comprising the coding means 12, the transmitting means 13 and a clock 43. The microcontroller 32 has the embedded random access memory 34 and the embedded read-only memory 35, which is used for program storage. The remote control device 6 can be realized with a microprocessor 40, a random access memory 41, a read-only memory 42, the clock 43, a display 44, a keypad 45 and the transmitting means 13. The remote control device and the coding device could advantageously share the transmitting means 13 and the clock 43. Both the microprocessor 40 and microcontroller 32 can read the clock 43. The transmitting means 13 is used for transmitting the user-specified command and the device identifier.

The embodiment depicted in FIG. 4 comprises the controllable device and the decoding device with the combined receiving means 14. Said decoding device comprises the decoding means 16, the receiving means 14 and the clock 43. The microcontroller 32 has the embedded random access memory 34 and the embedded read-only memory 35, which is E for program storage. The controllable device 4 may comprise the microprocessor 40, the random access memory 41, the read-only memory 42, the clock 43 and the receiving means 14. The controllable device and the decoding device could advantageously share the receiving means 14 and the clock 43. Both the microprocessor 40 and microcontroller 32 can read the clock 43. The receiving means 14 is used for receiving the user-specified command and the device identifier. Further details of the internal design of the embodiments shown in FIGS. 3, 4 will be apparent to people skilled in the art.

An alternative to having the microcontroller 32, which can implement the coding or decoding means, is to build the coding and decoding functions directly into the program stored in the read-only memory 42. This would eliminate the need for the microcontroller 32. Of course, other hardware to perform the coding or decoding functions may also be used.

The described system of the present invention allows cost-effective implementations with the additional advantages of using the infrared communication. The remote control device may be the conventional remote control device producing infrared signals that are received by the controllable device. The controllable devices may include televisions, VCRs or other electronic appliances or devices capable of receiving the infrared signals. Accordingly, the coding device may be designed to receive the infrared signals produced by the remote control device. The infrared signals produced by the transmitting means of the decoding device can be adapted to transmit the same key characteristic (such as frequency and duration) as the infrared signals produced by the remote control device. Thus, said decoding device can communicate with the controlled device in the same way as the conventional remote control device would communicate with the controllable device.

Other implementations, which provide similar functions, could be substituted for the aforementioned implementations without departing from the scope of the present invention.

The method of the invention describes steps of operation of the system for remote control of at least two controllable devices: adding to the user-specified command a device identifier for identification of at least one of the controllable devices and transmitting the device identifier and the user-specified command.

Obviously, different frame structures may be used to compose a message including the device identifier and the user-specified command. For example, a header incorporating the device identifier may be added to the message with the user-specified command. Any digital, symbol or other format may be used for implementation of the device identifiers.

The method further comprises steps being executed at the decoding device: receiving the device identifier and the user-specified command; then extracting the device identifier, comparing said extracted device identifier with a further device identifier for identification of the controllable device. The method provides the steps of refraining from further operation with the received user-specified command if said identifiers do not match, and supplying the user-specified command to the controllable device if the identifiers do match.

The steps of receiving and sending the user-specified command or the device identifier and user-specified command could be modified accordingly for the system of the present invention. Thus, the step of supplying the user-specified command to the controllable device may comprise a step of transmitting the user-specified command to the controllable device. Also, the step of obtaining the user-specified command from the remote control device may comprise a step of receiving the user-specified command from the remote control device.

Before the afore-mentioned steps, the device identifiers have to be assigned to the associated controllable devices or to the groups of the controllable devices and then indicated in the decoding device. The device identifier could be indicated in the coding device with the help of the means for selecting the device identifiers, and in the decoding device with the help of the means for setting the further device identifiers associated with the controlled device. Various switches, buttons, keys, other hardware realizations or program products could implement these means for selecting and setting device identifiers.

The invention makes it possible to control many controllable devices by using the one remote control device with the means for selecting of the device identifiers. When each device identifier is associated with the only one controllable device, a user can select the associated device identifier at the remote control device and control this controllable device independently of the rest of them.

The remote control system of the present invention also allows the use of more than one remote control device equipped with the coding device. It is also possible to use the remote control devices equipped with the coding devices and the conventional remote control devices at the same time in the system.

The various program products may implement the functions of the system and method of the present invention and may be combined in several ways with the hardware or located in different devices. Variations and modifications of the described embodiment are possible within the scope of the inventive concept.

The invention claimed is:

1. A system for remote control of at least two like controllable devices, the system comprising:

a) a remote control device comprising:

a remote control input means for inputting a user-specified command for controlling the controllable devices; and a remote control transmitting means adapted to transmit the user-specified command;

b) a coding device comprising:

a coding input means for receiving the user-specified command from the remote control device;

a coding means designed to add to the user-specified command a device identifier for identification of at least one of the controllable devices;

a coding transmitting means adapted to transmit the device identifier and the user-specified command in combination;

c) the like controllable devices each comprising:

a receiving means adapted to receive the device identifier and the user-specified command in combination;

a decoding means designed (1) to extract the device identifier, (2) to compare said extracted device identifier with a further device identifier for identification of the controllable device, and (3) to refrain from further operation with the received user-specified command if said identifiers do not match;

an output means for supplying the user-specified command if said identifiers do match;

wherein the remote control device and the coding device are separate devices which are selectively interconnectable and disconnectable, the remote control device functioning to transmit the user-specified command to controllable devices when the coding device is disconnected and the coding device functioning to transmit the user-specified command when the remote control device and the coding device are connected.

2. The system according to claim 1, wherein the device identifier added by the coding means is user-selected and the further device identifier to which the decoding means compares the extracted device identifier is user-selected.

3. A system for remote control of a plurality of like controllable devices which are controllable with common commands, the system comprising:

a) a remote control device including:

an input means for inputting a user-specified one of the commands which control the plurality of like controllable devices;

a coding means configured to add to the user-specified command a device identifier for identification of at least a selected one of the controllable devices;

a transmitting means configured to transmit the device identifier and the user-specified command in combination;

b) a decoding device comprising:

a first receiving means configured to receive the device identifier and the user-specified command in combination;

a decoding means configured to (1) extract the device identifier and (2) compare said extracted device identifier with a user-specified device identifier for identification corresponding to the controllable selected device;

an output means configured for supplying the user-specified command to the corresponding controllable device if the identifiers match;

c) the controllable devices each comprising:

a second receiving means configured to receive the user-specified command from the corresponding decoding device output means;

a means for controlling the controllable device to implement each user-specified command received from the decoding device;

wherein the decoding device and the controllable devices are separate devices, the decoding device being selectively connectable to one of the controllable devices, when the decoding device is connected with the controllable device, the decoding device receives the transmitted device identifier and the user-specified command in combination from the coding device and when the decoding device is separate from the controllable device, the controllable device receives the user-specified command and the device identifier in combination from the coding device.

4. A system for remote control of a plurality of like controllable devices, the system comprising:

a) a remote control device comprising:

a remote control input means for inputting a user-specified command for controlling the controllable devices; and a remote control transmitting means adapted to transmit the user-specified command;

b) a coding device comprising:

a coding input means for receiving the user-specified command from the remote control device;

a coding means designed to combine the user-specified command and a device identifier for identification of at least one of the controllable devices;

a coding transmitting means adapted to transmit the device identifier and the user-specified command in combination;

c) a decoding device comprising:

a decoding receiving means adapted to receive the combined device identifier and the user-specified command from the coding device;

a decoding means designed to (1) extract the device identifier and (2) compare said extracted device identifier with a further device identifier for identification of an associated controllable device;

an output means for supplying the user-specified command to the associated controllable device if the identifiers match;

d) the controllable devices each comprising:

a receiving means adapted to receive the user-specified command from an associated decoding device output means;

a means for controlling the controllable device to carry out the user-specified command received by the coding device; and e) wherein at least one of:

the remote control device and the coding device are separate devices which are selectively interconnectable and disconnectable, the remote control device functioning to transmit the user-specified command to controllable devices when the coding device is disconnected and the coding device functioning to transmit the user-specified command when the remote control device and the coding device are connected; and the decoding device and the controllable devices are separate devices, the decoding device being selectively connectable to one of the controllable devices, when the decoding device is connected with the controllable device, the decoding device receives the transmitted device identifier and the user-specified command in combination from the coding device and when the decoding device is separate from the controllable device, the controllable device receives the user-specified command and the device identifier in combination from the coding device.

5. A method for remote control of at least two like controllable devices, the method comprising:

a) with a remote control device, inputting a user-specified command for controlling the controllable devices; and transmitting the user-specified command;

b) with a coding device, receiving the user-specified command from the remote control device;

adding to the user-specified command a device identifier for identification of at least one of the controllable devices;

transmitting the device identifier and the user-specified command in combination;

c) with one of the like controllable devices, receiving the device identifier and the user-specified command in combination;

extracting the device identifier;

comparing said extracted device identifier with a further device identifier for identification of the controllable device;

refraining from further operation with the received user-specified command if said identifiers do not match; and supplying the user-specified command if said identifiers do match;

wherein the remote control device and the coding device are separate devices which are selectively interconnectable and disconnectable, and wherein the step of transmitting the user specified command further includes:

transmitting the user-specified command from the remote control device to controllable devices when the coding device is disconnected and transmitting the user-specified command and the device identifier from the coding device to the controllable devices when the remote control device and the coding device are connected.

6. A method for remote control of a plurality of like controllable devices which are controllable with common commands, the method comprising:

a) with a remote control device, inputting a user-specified one of the common commands which control the plurality of like controllable devices;

adding to the user-specified command a device identifier for identification of at least a selected one of the controllable devices;

transmitting the device identifier and the user-specified command in combination;

b) with a decoding device, receiving the device identifier and the user-specified command in combination;

extracting the device identifier, comparing said extracted device identifier with a user-specified device identifier for identification of an identified one of the controllable devices;

supplying the user-specified command to the corresponding controllable device if the identifiers match;

c) with the identified controllable device, receiving the user-specified command from the corresponding decoding device output means;

controlling the identified controllable device to implement each user-specified command received from the decoding device;

wherein the decoding device and the controllable devices are separate devices, the decoding device being selectively connectable to the identified one of the controllable devices, and further including:

when the decoding device is connected with the identified controllable device, receiving the transmitted device identifier and the user-specified command in combination from the coding device with the decoding device, and when the decoding device is separate from the controllable device, receiving the user-specified command and the device identifier in combination from the coding device with the identified controlling device.

* * * * *